US008576134B2

(12) United States Patent
Lan

(10) Patent No.: US 8,576,134 B2
(45) Date of Patent: Nov. 5, 2013

(54) ROTARY CASING OF SATELLITE ANTENA HAVING AN ANGLE ADJUSTABLE DISPLAY SCREEN

(75) Inventor: Hung-Wei Lan, Xindian (TW)

(73) Assignee: Timotion Technology Co., Ltd., New Taipei (TW)

( * ) Notice: Subject to any disclaimer, the term of this patent is extended or adjusted under 35 U.S.C. 154(b) by 800 days.

(21) Appl. No.: 12/822,242

(22) Filed: Jun. 24, 2010

(65) Prior Publication Data

US 2011/0315825 A1 Dec. 29, 2011

(51) Int. Cl.
*H01Q 3/00* (2006.01)

(52) U.S. Cl.
USPC ..... 343/765; 343/766; 343/763

(58) Field of Classification Search
USPC ..... 343/760, 757, 765, 766; 244/158
See application file for complete search history.

(56) References Cited

U.S. PATENT DOCUMENTS 8,259,020 B1 * 9/2012 Macy et al. ..... 343/766
2005/0280594 A1 * 12/2005 Dennison et al. ..... 343/766

* cited by examiner

*Primary Examiner* — Hoang V Nguyen
*Assistant Examiner* — Kyana R McCain
(74) *Attorney, Agent, or Firm* — Chun-Ming Shih; HDLS IPR Services

(57) ABSTRACT

A rotary casing of a satellite antenna having an angle adjustable display screen includes a supporting arm, a hollow casing, a rotating means and an adjusting and controlling assembly. The casing has a panel provided with two keys and a top surface provided with a window. The rotating means is provided in the casing and controlled by the keys to drive the rotation of the supporting arm. The adjusting and controlling assembly is provided in the casing and includes a control unit and a display unit. The two keys are electrically connected to the control unit to drive the supporting arm. By this arrangement, the control unit receives an adjustment instruction inputted by the keys and transmits the instruction to the rotating means to generate a corresponding amount of rotation, while the control unit converts the instruction into a numerical value to be displayed on the display unit.

5 Claims, 5 Drawing Sheets

ROTARY CASING OF SATELLITE ANTENA HAVING AN ANGLE ADJUSTABLE DISPLAY SCREEN

BACKGROUND OF THE INVENTION

1. Field of the Invention

The present invention relates to a satellite antenna, in particular to a rotary casing of a satellite antenna having an angle adjustable display screen.

2. Description of Prior Art

Since current satellites have an increasing capacity for transmitting signals, the angle of the satellite antenna has to be more precise. Thus, the angle of the satellite antenna is required to be adjusted more precisely and accurately.

The casing of the conventional satellite antenna is provided with an angle adjusting means having graduations. When the casing rotates, the angle of rotation can be determined by calculating the difference of graduations before and after the rotation. Because the graduations are provided on the positions at which a user cannot see the graduations easily and clearly, it is inconvenient for the user to adjust the angle of the satellite antenna.

In view of the above, the present Inventor proposes a novel and reasonable structure to solve the above-mentioned problems based on his researches and expert knowledge.

SUMMARY OF THE INVENTION

The present invention is to provide a rotary casing of a satellite antenna having an angle adjustable display screen. A display unit is provided in the rotary casing of the satellite antenna for calculating a numerical value for the angle adjustment. Further, a display window is provided on the rotary casing. The user can watch the display window to recognize the numerical value after adjustment, thereby facilitating the angle adjustment of the satellite antenna.

The present invention provides a rotary casing of a satellite antenna having an angle adjustable display screen, which includes a supporting arm, a hollow casing, a rotating means, and an adjusting and controlling assembly. The casing has a panel and a top surface. The panel is provided with two keys, and the top surface is provided with a window. The rotating means is provided in the casing and controlled by the two keys to drive the supporting arm to rotate forwardly or reversely for angle adjustment. The adjusting and controlling assembly is provided in the casing and includes a control unit and a display unit electrically connected to the control unit. The two keys and the control unit are electrically connected to each other and the supporting arm can be driven by the control unit. The display unit is located under the window. By this arrangement, the control unit receives an adjustment instruction inputted by the two keys and transmits the adjustment instruction to the rotating means to generate a corresponding amount of rotation. Further, the control unit converts the adjustment instruction into a numeric value to be displayed on the display unit.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
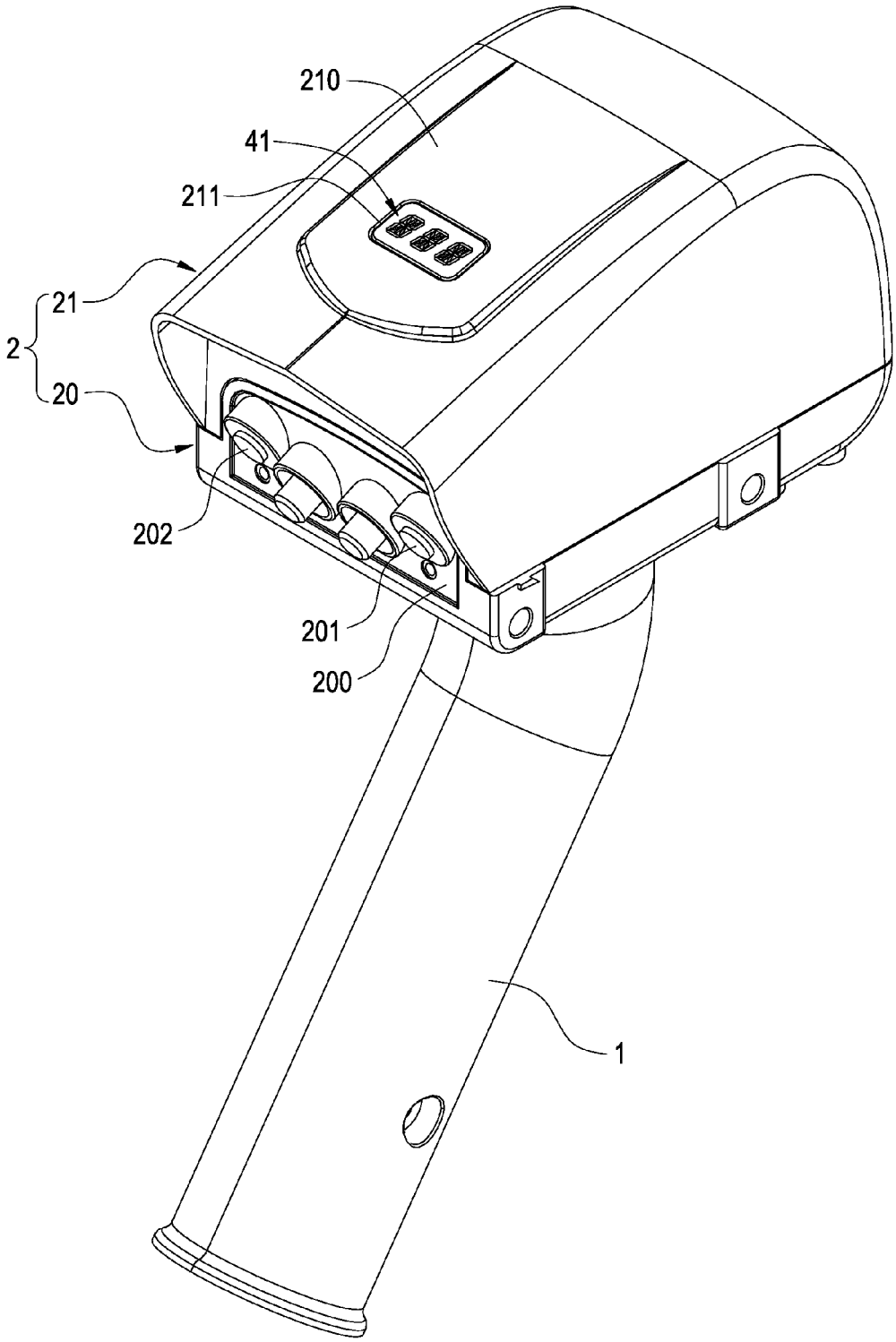
FIG. 1 is a perspective view showing the external appearance of the present invention.
Figure 2:
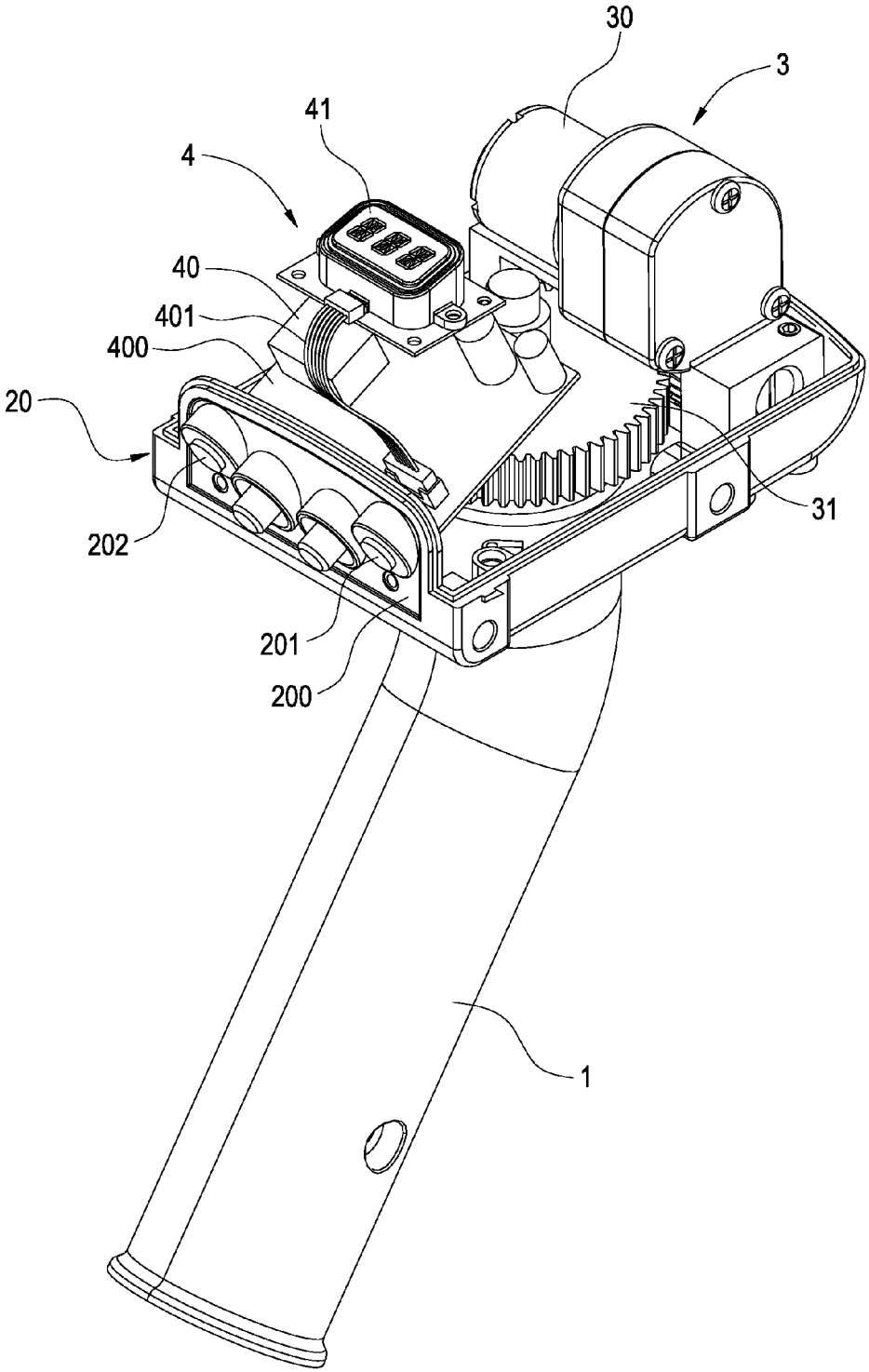
FIG. 2 is a schematic view showing the internal structure of a casing of the present invention.
Figure 3:
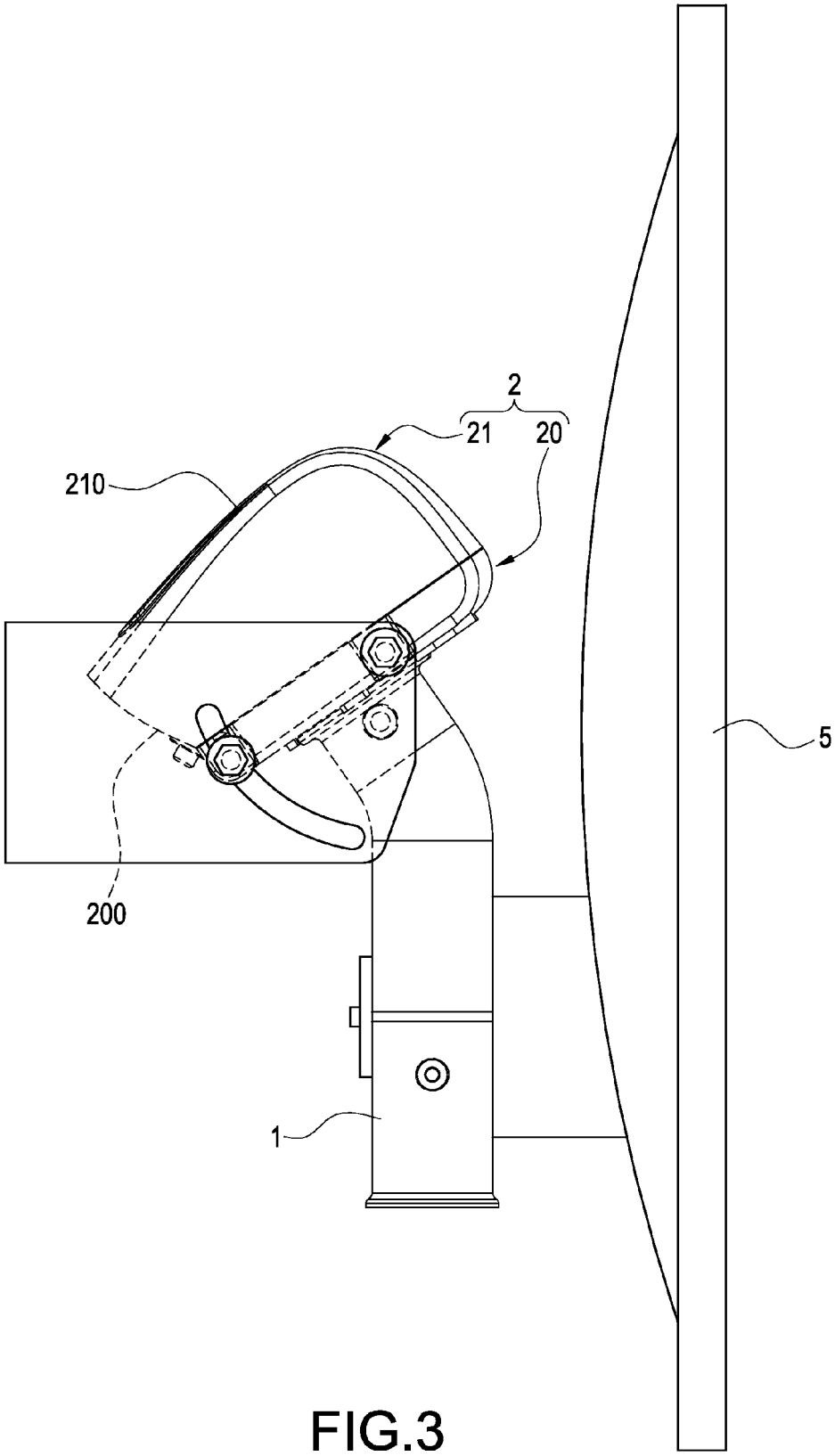
FIG. 3 is a schematic view showing the assembly of the present invention and a disk.

Please refer to FIGS. 1 and 2. FIG. 1 is a perspective view showing the external appearance of the present invention, and FIG. 2 is a schematic view showing the internal structure of a casing of the present invention. The present invention provides a rotary casing of a satellite antenna having an angle adjustable display screen, which includes a supporting arm 1, a casing 2, a rotating means 3 and an adjusting and controlling assembly 4.

Figure 5:
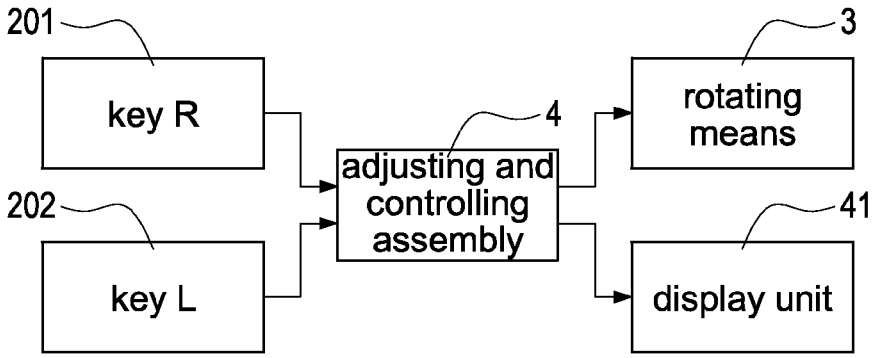
FIG. 5 is a block view showing the circuit of a first embodiment of the present invention.

The supporting arm 1 is configured to support and connect a disk 5 (as shown in FIG. 5) of the satellite antenna. After the supporting arm 1 is pivotally connected to the casing 2, the rotating means 3 provided in the casing 2 is configured to drive the rotation of the supporting arm 1. By this arrangement, the rotation angle of the disk 5 can be changed so as to adjust the position of the disk 5.

The interior of the casing 2 is hollow. The casing 2 comprises a tray 20 and a top shroud 21 covering above the tray 20. The rotating means 3 and the adjusting and controlling assembly 4 are received in the casing 2. Further, the rear end of the tray 20 has a panel 200. The panel 200 is provided with two keys 201 and 202. The key 201 is a key "R" for controlling the forwardly rotation of the rotating means 3. The key 202 is a key "L" for controlling the forwardly rotation of the rotating means 3.

The rotating means 3 is provided on the tray 20 of the casing 2. The rotating means 3 comprises a driving unit 30 and a rotating gear set 31 driven by the driving unit 30. The rotating gear set 31 is connected to the supporting arm 1, so that the driving unit 30 of the rotating means 3 can drive the rotating gear set 31 to thereby control the rotation of the supporting arm 1.

The adjusting and controlling assembly 4 is provided on the tray 20 of the casing 2 and is located closer to one side of the panel 200. The adjusting and controlling assembly 4 includes a control unit 40 and a display unit 41. The control unit 40 is provided on a circuit board 400. Through the circuit board 400, the control unit 41 is electrically connected to the two keys 201 and 202 and controlled thereby. Further, the circuit board 400 can be electrically connected to the display unit 41 through a flat cable 401.

Figure 4:
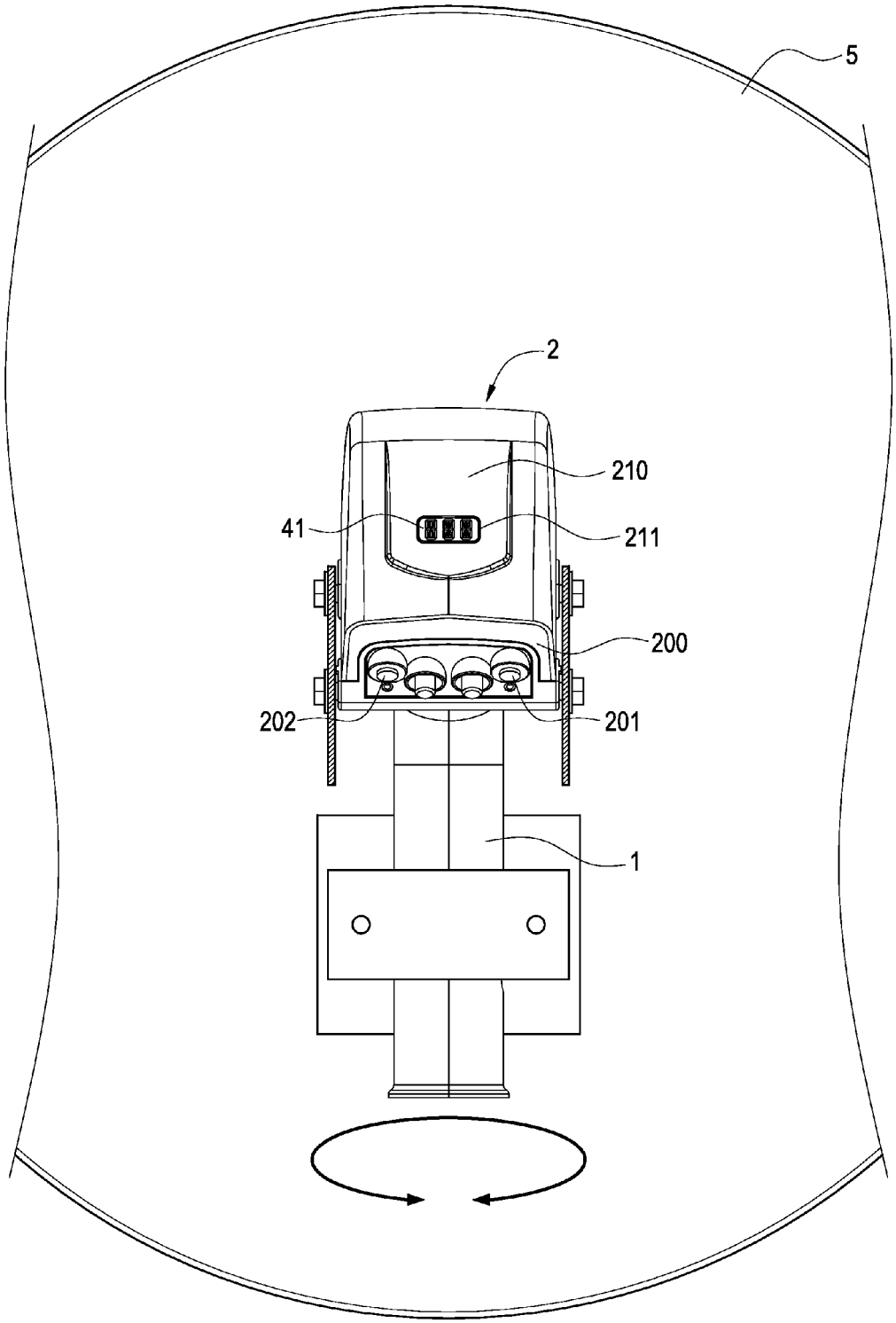
FIG. 4 is a schematic view showing the operation of the present invention and a disk.

According to the present invention, the top shroud 21 of the casing 2 has a top surface 201 on which a window 211 is provided. The display unit 41 of the adjusting and controlling assembly 4 is located under the window 211. Please also refer to FIGS. 4 and 5. When the user inputs an adjustment instruction through the two keys 201 and 202, the control unit 40 receives the adjustment instruction and transmits the adjustment instruction to the rotating means 3, thereby causing the driving unit 30 to generate a corresponding amount of rotation. At the same, the control unit 40 converts the adjustment instruction into a numerical value and displays the numerical value on the display unit 41, thereby facilitating the angle adjustment.

Figure 6:
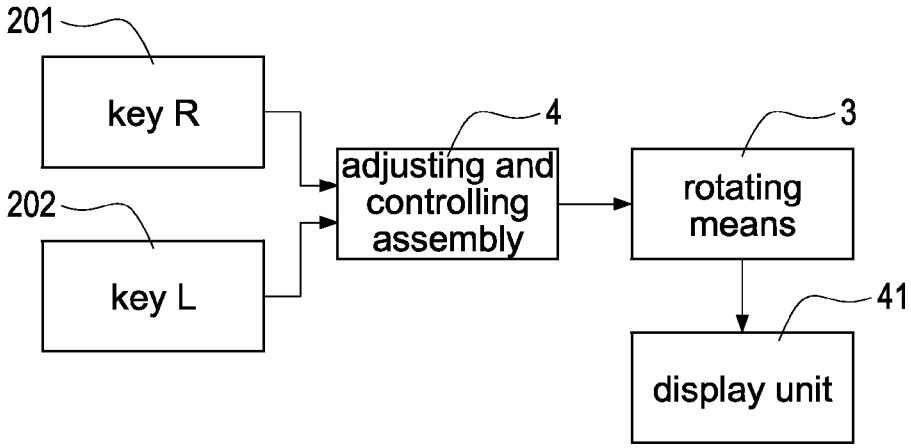
FIG. 6 is a block view showing the circuit of a second embodiment of the present invention.

Please refer to FIG. 6. In order to make sure that the numerical value displayed on the display unit 41 is consistent with the amount of rotation actually driven by the driving unit 30, the control unit 40 first transmits the received adjustment instruction to the rotating means 3 to cause the driving unit 30 to generate a corresponding amount of rotation. Thereafter, the control unit 40 converts the amount of rotation driven by the driving unit 30 into a digital signal and transmits the digital signal to the display unit 41 for display.

Therefore, with the above-mentioned arrangement, the rotary casing of a satellite antenna having an angle adjustable display screen is obtained.

According to the present invention, the user can hold the rear end of the casing 2 and operate the two keys 201 and 202 to adjust the rotation angle of the satellite antenna. Further, the user can watch the display unit 41 under the window 211 from the top of the casing 2, so that the user can immediately recognize the amount of rotation, thereby facilitating the angle adjustment.

According to the above, the present invention really achieves desired objects and solves the problems of prior art. Furthermore, the present invention has novelty and non-obviousness, conforming to the requirements for an invention patent.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A rotary casing of a satellite antenna having an angle adjustable display screen, comprising:

a supporting arm (1);

a casing (2) having a hollow interior, the casing (2) directly installed on the supporting arm (1) and having a panel (200) and a top surface (210), the panel (200) being provided with two keys (201 and 202), the top surface (210) having a window (211);

a rotating means (3), provided in the casing (2) and controlled by the two keys (201 and 202) to thereby drive the supporting arm (1) to rotate forwardly or reversely for angle adjustment; and an adjusting and controlling assembly (4), provided in the casing (2) and including a control unit (40) and a display unit (41) electrically connected to the control unit (40), the two keys (201 and 202) being electrically connected to the control unit (41) to thereby drive the supporting arm (1), the display unit (41) being located under the window (211);

wherein the control unit (40) receives an adjustment instruction inputted by the two keys (201 and 202) and transmits the adjustment instruction to the rotating means (3) to generate a corresponding amount of rotation, while the control unit (40) converts the adjustment instruction into a numeral angle value of the supporting arm (1) to be displayed on the display unit (41).

2. The rotary casing of a satellite antenna having an angle adjustable display screen according to claim 1, wherein the casing (2) comprises a tray (20) and a top shroud (21) covering above the tray (20), and the panel (200) is located at a rear end of the tray (20).

3. The rotary casing of a satellite antenna having an angle adjustable display screen according to claim 2, wherein the window (211) is located on the top surface (210) of the top shroud (21).

4. The rotary casing of a satellite antenna having an angle adjustable display screen according to claim 1, wherein the rotating means (3) comprises a driving unit (30) and a rotating gear set driven by the driving unit (30), the rotating gear set (31) is connected to the supporting arm (1), and the driving unit (30) of the rotating means (3) drives the rotating gear set (31) to control the rotation of the supporting arm (1).

5. The rotary casing of a satellite antenna having an angle adjustable display screen according to claim 1, wherein the control unit (40) receives the adjustment instruction and transmits the adjustment instruction to the rotating means (3) to order the driving unit (30) to generate the corresponding amount of rotation, the control unit (40) converts an analog signal representing the actual amount of rotation driven by the driving unit (30) into a digital signal and transmits the digital signal to the display unit (41).

* * * * *